US009228456B2

(12) United States Patent
Gross et al.

(10) Patent No.: US 9,228,456 B2
(45) Date of Patent: Jan. 5, 2016

(54) VALVE DRIVE OF AN INTERNAL COMBUSTION ENGINE

(71) Applicant: AUDI AG, Ingolstadt (DE)

(72) Inventors: Michael Gross, Ingolstadt (DE); Hendrik Schramm, Ingolstadt (DE); Moayed El-Gaml, Stuttgart (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 14/397,445

(22) PCT Filed: Apr. 26, 2013

(86) PCT No.: PCT/EP2013/001259

§ 371 (c)(1),
(2) Date: Oct. 27, 2014

(87) PCT Pub. No.: WO2013/159937

PCT Pub. Date: Oct. 31, 2013

(65) Prior Publication Data

US 2015/0122209 A1 May 7, 2015

(30) Foreign Application Priority Data

Apr. 28, 2012 (DE) ..... 10 2012 008 698

(51) Int. Cl.
*F01L 1/34* (2006.01)
*F01L 1/344* (2006.01)
*F01L 13/00* (2006.01)

(52) U.S. Cl.
CPC ..... *F01L 1/34403* (2013.01); *F01L 13/0036* (2013.01)

(58) Field of Classification Search
CPC ..... F01L 1/34403; F01L 13/0036
USPC ..... 123/90.16
See application file for complete search history.

(56) References Cited

U.S. PATENT DOCUMENTS

| | | | | |
|---|---|---|---|---|
| 7,409,938 | B2 | 8/2008 | Dengler | |
| 8,201,530 | B2 * | 6/2012 | Talan | F01L 13/0036 123/90.18 |
| 2008/0215228 | A1 | 9/2008 | Krebber-Hortmann | |
| 2011/0185995 | A1 | 8/2011 | Deblaize | |
| 2012/0138000 | A1 | 6/2012 | Schädel | |

FOREIGN PATENT DOCUMENTS

| | | |
|---|---|---|
| DE | 10 2009 034 990 | 2/2001 |
| DE | 10 2004 011 586 | 10/2004 |

(Continued)

OTHER PUBLICATIONS

International Search Report issued by the European Patent Office in International Application PCT/EP2013/001259.

*Primary Examiner* — Zelalem Eshete
(74) *Attorney, Agent, or Firm* — Henry M. Feiereisen LLC.

(57) ABSTRACT

A valve drive of an internal combustion engine is disclosed , having at least one main camshaft, on which at least one cam carrier is provided such that it is fixed so as to rotate with said main camshaft and can be displaced axially between at least two axial positions, wherein at least one valve actuating cam for actuating a gas exchange valve of the internal combustion engine is assigned to the cam carrier. The valve actuating cam is mounted rotatably and a rotary angular position of the valve actuating cam with regard to the cam carrier can be set by means of an adjusting device.

11 Claims, 4 Drawing Sheets

(56) References Cited

FOREIGN PATENT DOCUMENTS

| | | |
|---|---|---|
| DE | 103 49 902 | 6/2005 |
| DE | 10 2005 031 241 | 1/2007 |
| DE | 10 2007 010 151 | 4/2008 |
| DE | 10 2007 024 600 | 11/2008 |
| DE | 10 2008 036 030 | 2/2010 |
| DE | 10 2009 014 517 | 9/2010 |
| DE | 10 2010 004 591 | 7/2011 |
| DE | 10 2010 035 186 | 3/2012 |
| WO | WO 2010/012371 | 2/2010 |

* cited by examiner

VALVE DRIVE OF AN INTERNAL COMBUSTION ENGINE

CROSS-REFERENCES TO RELATED APPLICATIONS

This application is the U.S. National Stage of International Application No PCT/EP2013/001259, filed Apr. 26, 2013, which designated the United States and has been published as International Publication No. WO 2013/159937 and which claims the priority of German Patent Application, Serial No. 10 2012 008 698.9, filed Apr. 28, 2012, pursuant to 35 U.S.C. 119(a)-(d).

BACKGROUND OF THE INVENTION

The invention relates to a valve drive of an internal combustion engine with at least one main camshaft on which at least one cam carrier is provided in fixed rotative relationship to the main camshaft and axially shiftable between two axial positions, wherein at least one valve actuating cam for actuating a gas exchange valve of the combustion engine is assigned to the cam carrier.

Valve drives of the aforementioned type are known from the state of the art. They are used in combustion engines in which the operating cycle of gas exchange valves of individual cylinders of the combustion engine can be influenced for improving the thermodynamic properties. The at least one cam carrier which can also be referred to as cam part, is arranged on the main camshaft in fixed rotative relationship with the camshaft and so as to be axially displaceable. Usually several, i.e., at least two valve-actuating cams are assigned to the cam carrier. Each of these valve-actuating cams has an eccentricity, which serves for actuating one of the gas exchange valves of the combustion engine at a defined rotational angle of the main camshaft. The valve-actuating cams thus co-rotate with the main camshaft so that the respective gas exchange valve of the combustion engine is actuated at least once per revolution of the main camshaft by the assigned valve-actuating cam or its eccentricity. For this purpose, the valve-actuating cam preferably interacts with a cam follower of the gas exchange valve through intimate contact with the cam follower.

Preferably multiple valve-actuating cams are provided which can be assigned to different cam groups. The valve-actuating cams of a cam group differ for example regarding the angular position of their eccentricity or the extent of the eccentricity in radial direction (height) and/or in circumferential direction (length). As a result of the axial displacement of the cam carrier, the cam carrier can be caused to assume at least two axial positions, for example a first and a second axial position. In the first axial position the gas exchange valve is actuated by a first one of the valve-actuating cams and in the second axial position by a second one of the valve-actuating cams, which are assigned to the same cam group. Displacement of the cam carrier thus allows in particular selecting the opening time point, the opening duration and/or the lift of the gas exchange valve, in particular in dependence on an operating state of the combustion engine.

The shifting or displacement of the cam carrier in axial direction occurs by means of an actuating device, which includes a shift gate assigned to the cam carrier and a positionally fixed actuator, which is usually fastened on a cylinder head of the combustion engine. The actuator has for example an extendable catch, which can be brought into engagement with an in particular helical or spiral-shaped sliding track of the shift gate. The sliding track is provided on the shift gate, which is assigned to the cam carrier. The shift gate is for example situated on the cam carrier or is at least operably connected with the cam carrier for effecting the axial shifting. The sliding track is preferably constructed as a radial groove, which traverses the circumference of the shift gate, i.e., it is formed in the shift gate so as to have an open rim. The shift gate has thus at least one sliding track into which the catch of the actuator can be introduced for shifting the cam carrier.

SUMMARY OF THE INVENTION

It is an object of the invention to propose a valve drive of a combustion engine, which enables further adjustment possibilities for the actuation of the gas exchange valve, in particular regarding the opening time point.

According to the invention this is achieved with a valve drive of an internal combustion engine, including at least one main camshaft; at least one cam carrier provided on the at least one main camshaft in rotative fixed relationship with the camshaft and axially displaceable between at least two axial positions; at least one valve-actuating cam for actuating a gas exchange valve of the internal combustion engine at least one valve-actuating cam being assigned to the cam carrier, said valve-actuating cam being rotataby supported and an angular position of the valve-actuating cam relative to the cam carrier is adjustable by means of an actuating device. The valve-actuating cam is rotatably supported and an angular position of the valve-actuating cam relative to the cam carrier is adjustable by means of an actuating device. The phase position of the valve-actuating cam relative to the main camshaft is thus variable. In this way the phase position of the valve-actuating cam can be changed in particular the opening time point of the gas exchange valve can be shifted to an earlier or later time point by adjusting the corresponding angular position by means of the actuating device. The angular position is preferably adjusted continuously or discretely in at least two stages. Thus at least two different angular positions can be adjusted. The angular position and the axial position can generally be adjusted in any desired order after each other or during at least partially overlapping time periods. In the valve drive according to the invention the angular position of the valve-actuating cam changes not only relative to the main camshaft but also relative to the cam carrier. The valve-actuating cam is thus rotatably supported relative to the main camshaft and also relative to the cam carrier and can be rotated by means of the actuating device.

Preferably the angular position of the valve-actuating cam is correspondingly adjustable independent of the axial position of the cam carrier. When the valve-actuating cam is displaceable together with the cam carrier in axial direction between the at least two axial positions it can also be provided that by correspondingly selecting the axial position, the desired valve-actuating cam is selected for actuating the gas exchange valve and in addition this valve-actuating cam is caused to assume an angular position in which a particularly advantageous operation is achieved in the present operating state of the combustion engine. The axial position and the angular position are preferably adjusted so that the power of the combustion engine is increased and/or its consumption or its emission is reduced.

It is particularly advantageous when multiple, i.e., at least two valve-actuating cams, in particular all valve-actuating cams or a cam group can together be brought into the desired angular position by means of the actuating device. Each of these valve-actuating cams has the eccentricity described above, wherein these can be present for the multiple valve-actuating cams at different angular positions and/or with different extents. In other words it can also be provided that only a single valve-actuating cam is displaceable, which however has multiple cam paths, wherein each cam path is provided with an eccentricity according to the above description.

A further refinement of the invention provides that the valve-actuating cam is supported rotatable at, in particular on the cam carrier and/or the main camshaft. The valve-actuating cam can in principle be arranged at any desired position relative to the cam carrier. For example it is seated in axial direction directly adjacent to the cam carrier on the main camshaft. Correspondingly the valve-actuating cam is supported on the cam carrier or on the main camshaft. Preferred is the first embodiment because in this case the valve-actuating cam is displaceable or shiftable together with the cam carrier in axial direction. It can also be provided that the valve-actuating cam is present on the cam carrier, i.e., embraces the cam carrier. For this purpose the valve-actuating cam has a for example central recess, which the cam carrier traverses in axial direction. The valve-actuating cam is thus supported on the cam carrier itself via a bearing, for example configured as sliding bearing or roller bearing. As an alternative the valve-actuating can of course also be spaced apart from the cam carrier in axial direction. In this case it is usually not displaceable together with the cam carrier by means of the actuating device.

A refinement of the invention provides that the actuating device has an axially displaceable switching element, which has a switching gear, wherein the switching gear is in engagement with a cam toothing, which is assigned to the valve-actuating cam, and the switching gear as well as the cam toothing are configured as helical toothing. The angular position of the valve-actuating cam is thus adjusted by means of the switching element, which is axially displaceable relative to the main camshaft and/or the cam carrier. Particularly preferably the switching element is supported rotatively fixed relative to the main camshaft, i.e., it co-rotates with the camshaft. The switching element has the switching gear, which is in engagement with the cam toothing. The cam toothing is assigned to the valve-actuating cam, and can thus in a preferred embodiment be formed on the valve-actuating cam.

As an alternative the cam toothing can also be present on a further element, which is preferably rigidly connected with the valve-actuating cam so that a rotational movement of the further element is transferable to the valve-actuating cam. The toothings are in each case configured as helical toothings or as threadings. Correspondingly the axial displacement of the switching element causes a rotational movement of the cam thoothing and correspondingly of the valve-actuating cam. The desired angular position of the valve-actuating cam can be adjusted by selecting the axial position of the switching element. Preferably the toothings are configured so that a change of the angular position can be caused by the change of the axial position. On the other hand a force acting on the valve-actuating cam in circumferential direction should not lead to a rotational movement of the valve-actuating cam and with this to a change of the axial position. The toothings are thus preferably configured self-inhibiting.

A refinement of the invention provides that the actuating device has at least one actuator shaft which can be axially displaced and/or rotated relative to the main camshaft and which is operably connected with eh actuating cams. The actuator shaft can in principle arranged in any desired manner. The actuator shaft is axially displaceable or rotatable relative to the main camshaft. In the first case the actuator shaft can for example be operably connected with the aforementioned switching element for actuating or axial displacement of the switching element. The operative connection of the actuator shaft with the valve-actuating cams is thus provided only indirectly via this switching element. When the actuator shaft is rotatable relative to the main camshaft it is preferably provided that it normally co-rotates with the main camshaft and is only rotated relative to the main camshaft for changing the angular position of the valve-actuating cam.

A refinement of the invention provides that the actuator shaft is operably connected with the valve-actuating cam via an adjusting gear. This is in particular the case when the adjustment of the angular position of the valve-actuating cam is to occur via the actuator shaft, which is rotatable relative to the main camshaft. The adjusting gear is provided in the operative connection between the actuator shaft and the valve-actuating cam so that a rotation of the actuator shaft leads to a change of the angular position of the valve-actuating cam. The adjusting gear can be configured so that the actuator shaft and the valve-actuating cam each have a toothing, wherein these toothings are directly in engagement with each other. Correspondingly a direct operative connection is given between the actuator shaft and the valve-actuating cam.

A refinement of the in invention provides that the adjusting gear includes at least one gear wheel, which is present in the operative connection between the actuator shaft and the valve-actuating cams. Correspondingly the operative connection between the actuator shaft and the valve-actuating cam is only configured indirect, i.e., via the at least one gear wheel. It is for example provided that the actuator shaft has a toothing, which is in engagement with a toothing of the gear wheel. The latter in turn is in engagement with a toothing of the valve-actuating cams. Preferably the rotation axes of the actuator shaft, the gear wheel and the valve-actuating cams are arranged parallel to each other. Of course as an alternative an angular offset can also be provided, wherein the toothings in this case are correspondingly configured. In the case of a parallel arrangement of the rotation axes, the actuator shaft, the gear wheel and the valve-actuating cams are arranged in the manner of a planetary gear; the adjusting gear is thus configured as planetary gear. Correspondingly also multiple gear wheels can be provided which are evenly distributed along the circumference of the actuator shaft. Particularly preferably here or four gear wheels are provide.

A refinement of the invention provides that a shaft toothing of the actuator shaft or the gear wheel is in engagement with the cam toothing of the valve-actuating cam. Such a configuration was already discussed above. The actuator shaft has the shaft toothing, the valve-actuating cam has the cam toothing. The toothing of the gear wheel is in engagement with both. Correspondingly a torque is transferable via the gear wheel between the actuator shaft and the valve-actuating cam for adjusting the angular position.

A refinement of the invention provides that the actuator shaft is received in the main camshaft and/or is arranged coaxial to the main camshaft. In principle the actuator shaft can be arranged in any desired manner relative to the main camshaft. It is particularly preferably when the main camshaft is configured as hollow shaft, wherein the actuator shaft is arranged in the hollow space present in the main camshaft. This enables a particularly space saving configuration of the valve drive. In this case it can be provided that the actuator shaft is arranged coaxial to the main camshaft. In this case the operative connection is preferably achieved via the above-described gear wheel in the manner of a planetary gear. Of course it can also be provided that the actuator shaft has a rotation axis, which does not coincide with the main camshaft but is rather spaced apart but parallel to the main camshaft. The entire actuator shaft or only regions thereof may be received in the main camshaft. In the latter case at least a region of the actuator shaft protrudes over the circumference of the main camshaft.

A refinement of the invention provides that the actuator shaft is operably connected with the valve-actuating cams via a holding element, which traverses the main camshaft. This holding element can for example be constructed as sliding block or the like. Via the holding element the valve-actuating cam is connected with the actuator shaft in rotative fixed relationship. A rotation of the actuator shaft thus directly causes a change of the angular position of the valve-actuating cam. The holding element traverses the main camshaft preferably in radial direction. This means that at least regions of the actuator shaft are received in the main camshaft, while the valve-actuating cam is present in radial direction outside the main camshaft. The holding element can permit an axial displacement of the actuator shaft and the valve-actuating cam relative to each other thus enabling additionally a displacement of the valve-actuating cam together with the cam carrier.

A refinement of the invention provides that the adjustment of the angular position and the axial position occurs by means of a single actuator. In addition multiple separate actuators may be present, wherein at least one is used for the axial displacement of the cam carrier and at least another one is used for adjusting the angular position. However, it is more advantageous to use only a single actuator and/or a single shift gate for adjusting the angular position and the axial position of the valve drive. In each or the mentioned embodiments each actuator and/or each shift gate can serve for adjusting at least two different angular positions and/or at least two axial positions. In order to enable the adjustment by means of the single actuator or the single shift gate it can be provided that the angular position and/or the axial position can be locked. For this for example the cam carrier is connected with the switching element and/or the actuator shaft.

The locking of the angular position and/or the axial position is for example realized by latching, so that for changing the angular position and/or the axial position a force has to be exerted, which exceeds a respective adjustment force. When now the adjustment force for adjusting the angular position is selected to be different from the adjustment force for adjusting the axial position (or vice versa) only one of the parameters can be changed in a targeted manner by exerting a first for example smaller force, and only the other, parameter can be changed by exerting a second for example greater force. In addition the locking can also occur in a switched, i.e., targeted manner. By releasing or creating the locking it can thus be influenced whether the angular position or the axial position is to be adjustable by means of the single actuator. Preferably the axial position is locked switchable, while the angular position is locked non-switchable. The adjustment of the angular position and the axial position is thus controlled via the locking by using the single actuator.

BRIEF DESCRIPTION OF THE DRAWING

In the following the invention is described in more detail by way of exemplary embodiments shown in the drawing, without limiting the invention. It is shown in.

DETAILED DESCRIPTION OF PREFERRED EMBODIMENTS

Figure 1:
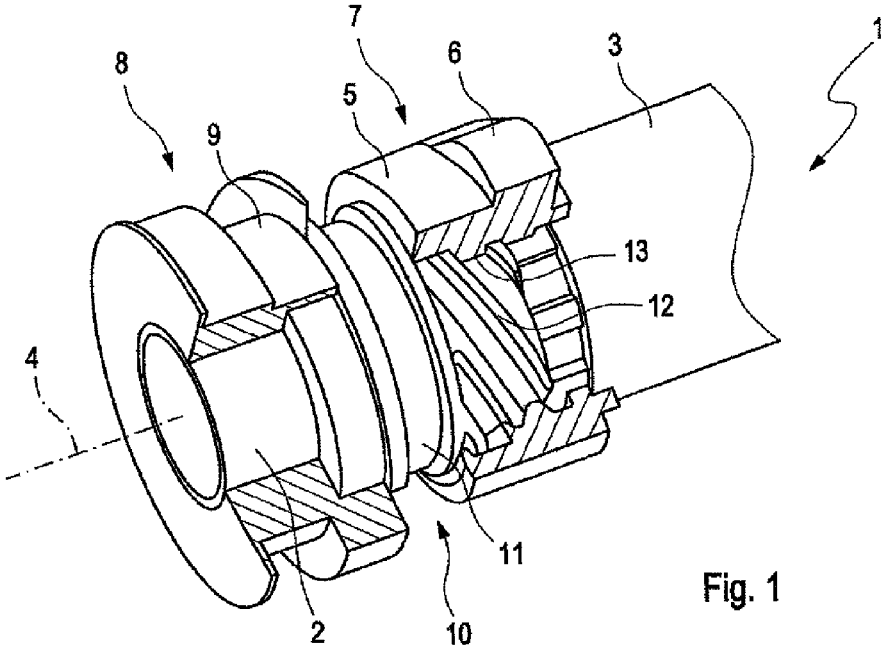
FIG. 1 a partially sectioned view of a region of a valve drive of a combustion engine in a first embodiment, FIG. 2 the valve drive in a second embodiment, FIG. 3 the valve drive in a third embodiment FIG. 4 a fourth embodiment of the valve drive, FIG. 5 the already known valve drive in a fifth embodiment, FIG. 6 a sixth embodiment of the valve drive FIG. 7 a seventh embodiment of the valve drive, and FIG. 8 an eight embodiment of the valve drive.

FIG. 1 shows a partially sectioned region of a valve drive 1 of a not further shown combustion engine. The valve drive 1 is formed by a main camshaft 2 and a cam carrier 3, which is axially displaceable on the main camshaft and which is here only schematically indicated. Axial direction means a direction, which is parallel to a longitudinal axis 4 or rotation axis of the main camshaft 2. The cam carrier 3 has a central recess, which is traversed by the main camshaft 2. In the region of the recess the cam carrier 3 has for example an internal toothing which interacts with an external toothing of the main camshaft (not shown here), in order to hold the cam carrier 3 rotatively fixed on the main camshaft 2, albeit axially displaceable. The cam carrier 3 has multiple valve-actuating cams 5 and 6 are assigned to a cam group 7. Beside the here shown valve-actuating cams 5 an 6 of the cam group 7, the cam carrier 3 can have at least one further cam group (not shown) with further valve-actuating cams. The cam carrier 3 also has a shift gate 8. By means of the axial actuating device the cam carrier 3 is displaceable on the main camshaft 2 in axial direction. The axial adjustment device includes for example a shift gate 8. As an alternative or in addition the axial adjustment device can have a further (here not shown) shift gate.

The valve-actuating cams 5 and 6 serve for actuating of not shown gas exchange of the combustion engine. The valve-actuating cams 5 and 6 are eccentric, wherein the eccentricities are present in different angular positions or circumferential positions relative to the cam carrier 3 and/or can have different extents in radial direction and/or circumferential directions. For actuating the here not shown gas exchange valve the valve-actuating cams 5 and 6 act interact for example with cam follower of the respective gas exchange valve through intimate contact. Each of the cam followers is assigned the respective valve-actuating cams 5 and 6 of the corresponding cam group 7. A first one of the cam followers is thus actuated by one of the valve-actuating cams 5 and 6 of the cam group 7 and a further one of the cam followers is actuated by one of the valve-actuating earns of a further cam group.

Due to the different configurations of the valve-actuating cams 5 and 6 of the cam group 7 compared to each other, a corresponding lift, opening time point and/or an opening duration of the gas exchange valve is thus established. By axial displacement of the cam carrier 3, the cam follower can be actuated by the valve-actuating cam 5 or 6 of the respective cam group 7. The cam carrier 3 is for example displaced in dependence on an operating state of the internal combustion engine so that always the valve-actuating cam 5 or 6 interacts with the corresponding cam follower for actuating the cam follower with which for example an optimal efficiency or an optimal power of the combustion engine can be achieved.

The displacement of the cam carrier 3 is accomplished by means of a here not shown actuator, which is also a component of the axial adjustment device and has a catch which can be displaced in axial direction. For displacing the cam carrier 3 the catch is displaced in axial direction so that it for example engages in a sliding track 9 of the shift gate 8 or in a sliding track of the further shift gate. The sliding track 9 is configured so that when the catch is introduced while the cam carrier 3 is located in a first, axial position, the shift gate 8 is urged in the direction of a second axial position, and vice versa. Of course a displacement of the cam carrier 3 between more than two axial positions is also possible and can be realized by means of a correspondingly adjusted shift gate 8 or axial adjustment device.

Beside the axial position of the cam carrier 3 and with this also the axial position of the valve-actuating cam 5 and 6, an additional angular position of the valve-actuating cams 5 and 6 relative to the cam carrier 3 is to be adjustable. For this purpose an actuating device 10 is provided. In addition the valve-actuating cams 5 and 6 are supported rotatable. This rotatable support is in the here shown exemplary embodiment provided in the cam carrier 3. The actuating device 10 has an axially displaceable switching element 11. The latter embraces the main camshaft 2 and is thus supported on the main camshaft so as to be axially displaceable, The switching element 11 itself is in regions embraced by the valve-actuating cam 5 and 6, which in the here shown embodiment are configured one-piece and in material unity. The switching element 11 has a switching toothing 12, which is constructed as outer toothing, while the valve actuating cams 5 and 6 have a cam toothing 13 configured as inner toothing. The switching toothing 12 and the cam toothing 13 are configured as helical toothing and engage with each other. This means that by displacing the switching element 11 in axial direction a rotation movement of the valve-actuating cams 5 and 6 is achieved. By correspondingly selecting the axial position of the switching element 11, the angular position of the valve-actuating cams 5 and 6 can thus be adjusted or selected. In the here shown embodiment the switching element 11 is operably connected with the shift gate 8. By means of the shift gate 8 the switching element 11 can thus be displaced in axial direction so that the rotational movement of the valve-actuating cams 5 and 6 is achieved.

Figure 2:
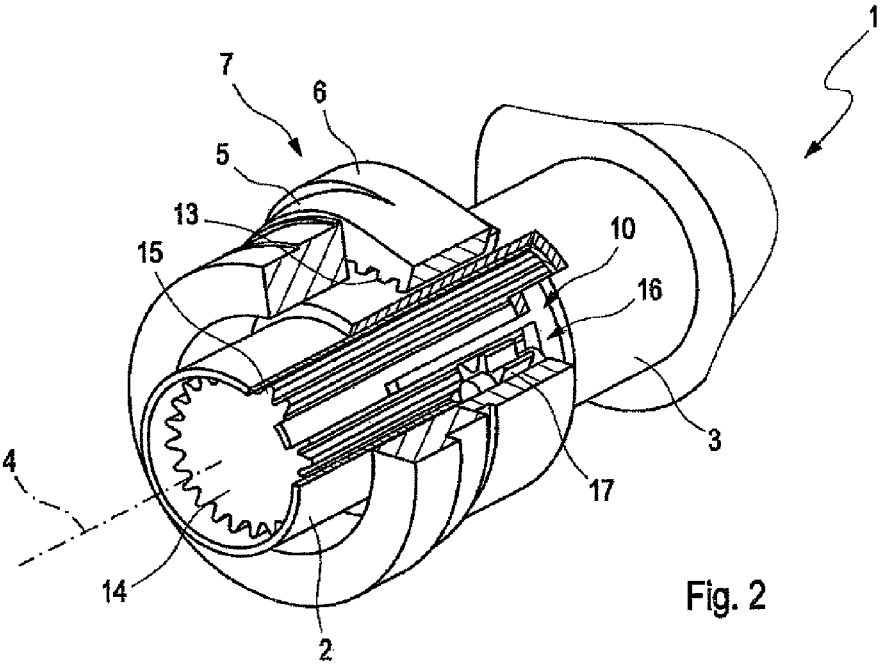

FIG. 2 shows the valve drive 1 in a second embodiment. This embodiment and the embodiments described in the following are principally similar to the one described by way of FIG. 1 so that insofar reference is made to the description above. In the second embodiment the valve drive 1 has an actuator shaft 14, which is rotatable relative to the main camshaft 2. The actuator shaft 14 is arranged in the main camshaft 2, which is configured as hollow shaft, wherein the main camshaft 2 and the actuator shaft 14 are coaxial, i.e., have the same rotation axis 4. The actuator shaft 14 has a shaft toothing 1, which is configured as outer toothing. Via this shaft toothing 15 an operative connection between the actuator shaft 14 and the valve-actuating cams 5 and 6 is established so that in case of a rotation of the actuator shaft 14 the angular position of the valve-actuating cams 5 and 6 changes. For establishing the operative connection the valve-actuating cams 5 and 6 have a cam toothing 13, which in this case is however configured as straight toothing.

Between the actuator shaft 14 and the valve-actuating cams 5 and 6 an adjusting gear 16 is provided which in the present exemplary embodiment has at least one gear wheel 17. Preferably multiple gear wheels 17 are provided, which are present in radial direction between the actuator shaft 14 and the valve-actuating cams 5 and 6. The gear wheel 17 or its toothing is in engagement with the shaft toothing 15 as well as with the cam toothing 13. As a result of a rotational movement of the actuator shaft 14 the angular position of the valve-actuating cams 5 and 6 can thus be changed.

Figure 3:
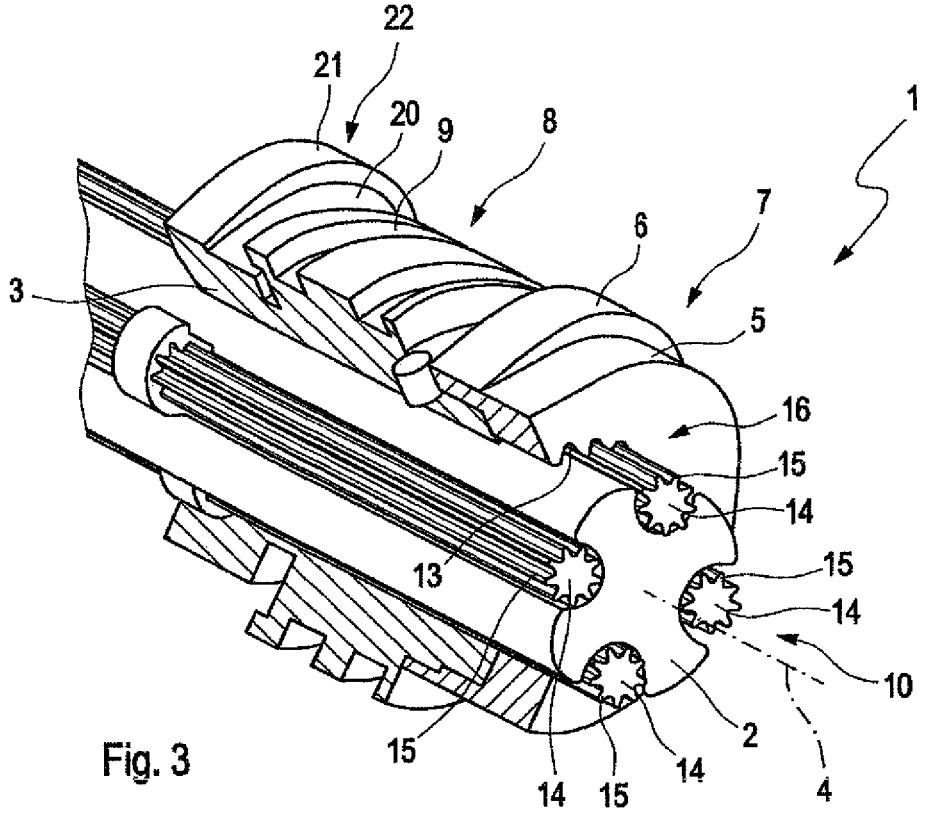

FIG. 3 shows a further embodiment of the valve drive 1. In this embodiment multiple actuator shafts 14, for example three or four, are provided. In this embodiment the gear wheel 17 is not included because the shaft toothing 15 protrudes over the circumference of the main camshaft 2 and can thus directly engage with the cam toothing 13. The actuator shafts 14 have rotation axes, which are different from the rotation axis 4, which however are parallel spaced apart from the rotation axis 4. The actuator shafts 34 are arranged symmetrical relative to the rotation axis 4, and are in particular evenly distributed over the circumference of the main camshaft 2.

Figure 4:
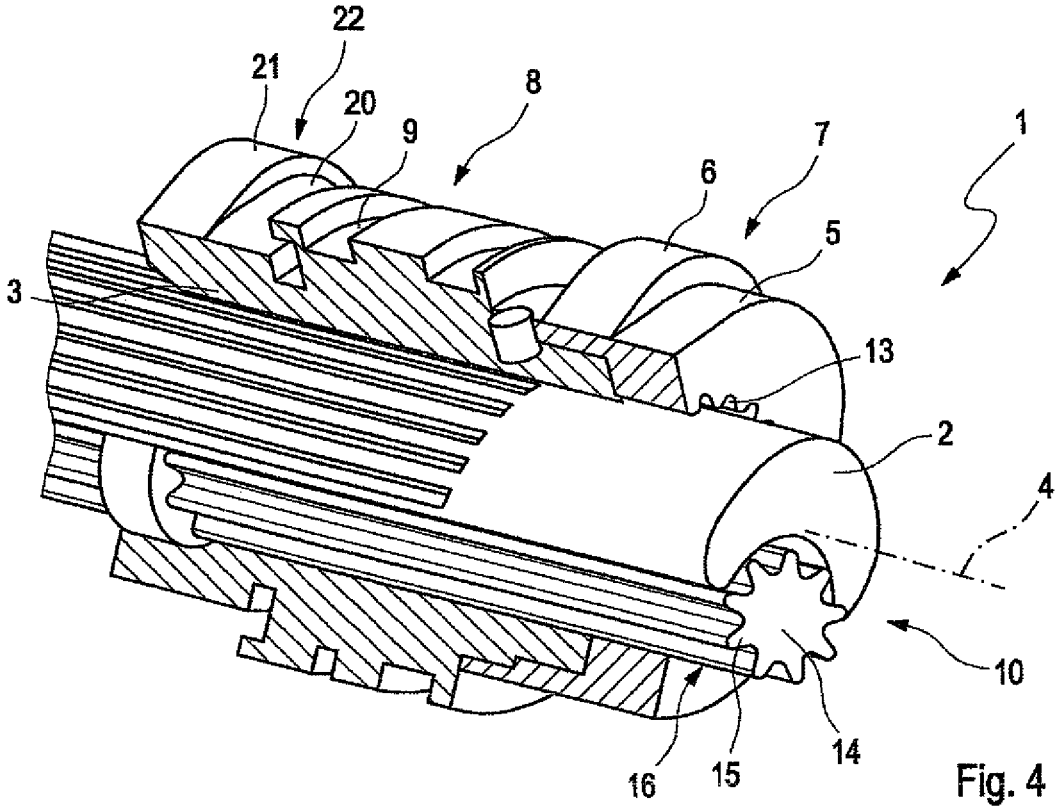

FIG. 4 shows the valve drive 1 in a fourth embodiment. In this embodiment only one actuator shaft 14 is provided, which is arranged so that its shaft toothing 15 can engage with the cam toothing 13. Otherwise the shown valve drive 1 is configured analogous to the valve drive described by way of FIG. 3.

Figure 5:
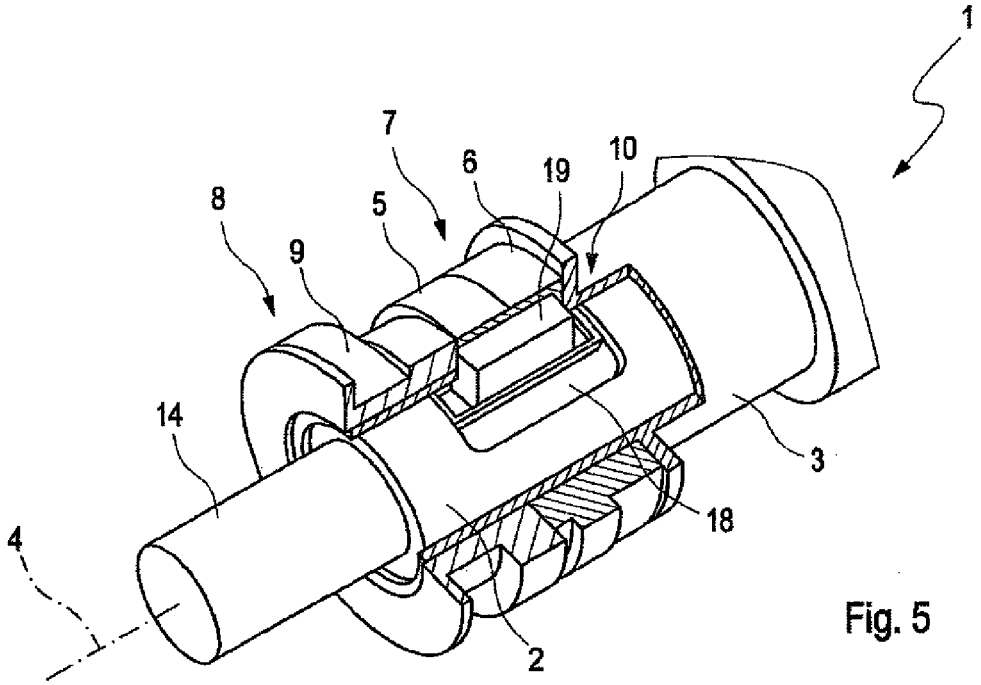
Figure 6:
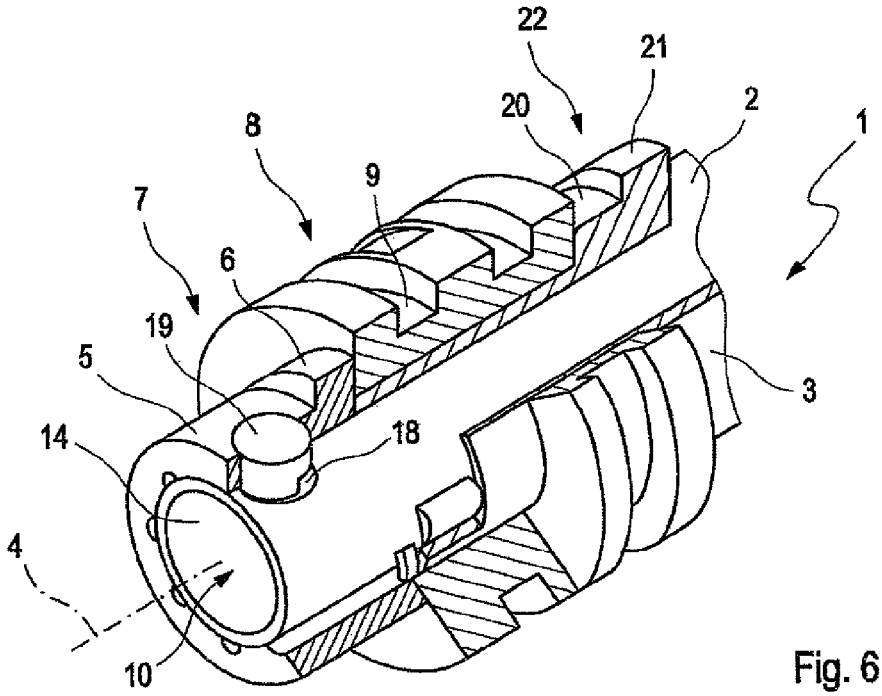

FIG. 5 describes a fifth embodiment of the valve drive 1. In this embodiment the actuator shaft 14 is also received in the main camshaft 2 and rotatably supported in the main camshaft. By a recess 18 on the main camshaft 2, which again is configured as hollow shaft, the operative connection between the actuator shaft 14 and the valve-actuating cams 5 and 6 is established via a holding element 19, which in this case is configured as a sliding block. The holding element 19 engages in regions of a recess of the valve-actuating cams 5 and 6, which recess is form fitted in circumferential direction to the holding element 19, and is held rotatatively fixed on the actuator shaft 14, however, preferably axially displaceable. Correspondingly by rotating the actuator shaft 14 relative to the main camshaft 2 the angular position .of the valve-actuating cams 5 and 6 can be changed. At the same time however an axial displacement of the valve-actuating cams 5 and 6 is possible together with the cam carrier 3, without having to axially displace the actuator shaft 14 as well.

Figure 8:
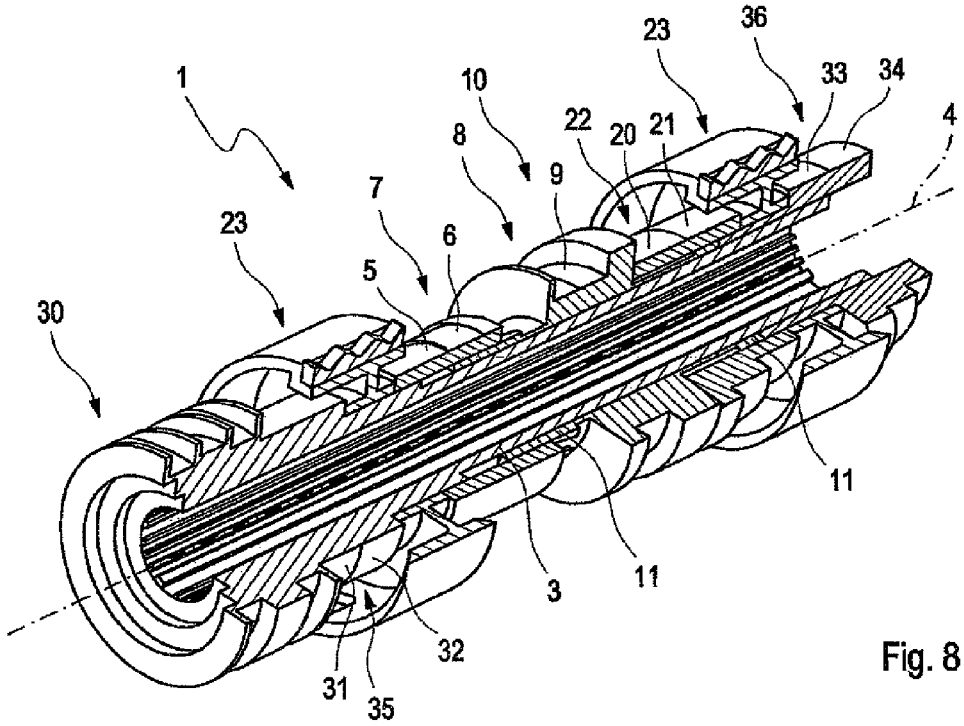

FIG. 8 shows a sixth embodiment of the valve drive 1. it can be seen that the valve-actuating cams 5 and 6 are not arranged on the cam carrier 3 but adjacent the cam carrier. They are either supported on the cam carrier 3 or directly on the main camshaft 2. It can also be provided that by means of the cam carrier 3 only further valve-actuating cams 20 and 21 of a further cam group 22 are displaced in axial direction. In this exemplary embodiment the valve-actuating cams 5 and 6 of the cam group 7 are not displaceable together with the cam carrier 3. Rather, only their angular position relative to the main camshaft 2 and the cam carrier 3 is adjustable. For this purpose, analogous to the embodiment described by way of FIG. 5, a holding element, which traverses the recess 18, is provided via which the operative connection between the actuator shaft 14 and the valve-actuating cams 5 and 6 is established. Of course also in this embodiment a support of the valve-actuating cams 5 and 6 on the cam carrier 3 can be provided so that also in this case the axial displacement as well as the adjustment of the angular position for the valve-actuating cams 5 and 6 can occur.

Figure 7:
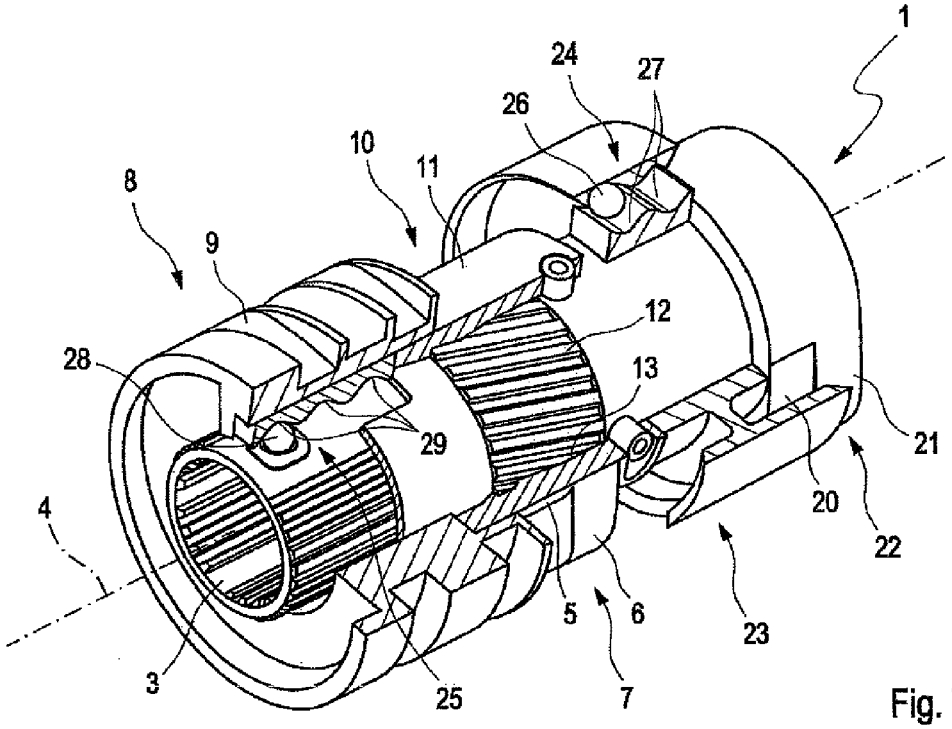

FIG. 7 shows a seventh embodiment of the valve drive 1. In this embodiment as already explained above, the valve-actuating cams 20 and 21 are provided in addition to the valve-actuating cams 5 and 6. The main camshaft 2 is not shown. The cam carrier 3 is supported by means of a bearing 23, for example a cylinder head housing. The bearing 23 holds the cam carrier 3 in radial direction, however permits an axial displacement along the longitudinal axis 4. The shift gate 8 is configured as the only shift gate of the cam carrier 3. This means that by means of the shift gate 8 the cam carrier 3 is displaceable in axial direction, and the switching element 11 is actuatable. In order to achieve this, a first locking device 24 is assigned to the cam carrier 3 and a second locking device 25 is assigned to the switching element 11. The first locking device 24 is formed by a latching element 26 for example a ball, which is held in position in axial direction. The latching element 26 engages in one of multiple latching recesses 27, which are arranged on the cam carrier 3. The latching element 26 is urged in radial direction, i.e., toward the longitudinal axis 4. Correspondingly a defined first actuating force is required for displacing the cam carrier 3 in axial direction, in order to displace the latching element out of the current latching recess.

The second locking device 26 is for example constructed analogous to the first locking device 24 and is formed by a latching element 28 and multiple latching recesses 29. However, other embodiments are also conceivable. The latching element 28 is for example fastened on the cam carrier 3, the latching recesses 29 on the shift gate 8. In the shown embodiment, the latching element 28 is urged outwardly in radial direction, so that it engages in one of the latching recesses 29. Thus the shift gate 8 can be displaced in axial direction relative to the cam carrier 3 by exerting a second displacement force. The shift gate 8 is operably connected with the switching element 11 so that such an axial displacement also causes an axial displacement of the switching element 11 and as a result a change of the angular position of the valve-actuating cams 5 and 6.

By correspondingly selecting the first actuating force and the second actuating force it can thus be achieved that when exerting a defined force on the shift gate 8 in axial direction, first an adjustment of the angular position or an adjustment of the axial position of the cam carrier 3 occurs. Only when reaching an end position by the element, which has the smaller actuating force, the element is thus adjusted, which has the greater actuating force. Of course at least one of the locking devices 24 and 25, preferably both can be configured switchable. In this case the latching element 26 or the latching element 28 can be displaced out of the respective recess 27 or 29 in a targeted manner so that the respective actuating force is selectable. Thus for example the latching element 26 can be displaced out of the latching recess 27 in order to only cause a displacement of the cam carrier 3 upon the next actuation of the shift gate 8 but not a displacement of the switching element 11. Vice versa, the latching element 26 can be urged in the direction of the latching recess 27 so that in case of such an actuation of the shift gate 8 no displacement of the cam carrier 3 can occur, so that instead the switching element 11 is moved and thus the desired angular position of the valve-actuating cams 5 and 6 is adjusted.

FIG. 8 shows an eighth embodiment of the valve drive 1. In this embodiment the valve-actuating cams 5 and 6 or 20 and 21 of the cam group 7 and 22 are respectively arranged immediately adjacent the shift gate 8. In addition to the shift gate 8 a further shift gate 30 is provided which is assigned to the axial adjustment device. By means of the shift gate 30 the cam carrier 3 can be displaced in axial direction. The shift gate 8 in contrast serves for adjusting the angular position of the valve-actuating cams 5 and 6 of the cam group 7 as well as the valve-actuating cams 20 and 21 of the cam group 22. For this purpose the shift gate 8 is supported on the cam carrier 3 for displacement in axial direction and has two switching elements 11 one of which is assigned to the valve-actuating cams 5 and 6 and another one to the valve-actuating cams 20 and 21.

The cam carrier 3 is for example supported by means of bearings 23. The cam carrier 3 can be assigned to one or multiple cylinders of the internal combustion engine and serve for actuation of the respective valve-actuating cams. Beside the valve-actuating cams 5, 6, 20 and 21 it can have further valve-actuating cams 31, 32, 33 and 34, which are assigned to cam groups 35 and 36. These valve-actuating cams 31 to 34 are fixedly arranged on the cam carrier 3. They are thus displaceable together with the cam carrier 3 in axial direction, however they are not adjustable by means of the shift gate 8 regarding their angular position. The respective switching gear 12 and cam toothing 13 of the valve-actuating cams 5 and 6 or 20 and 21 can be configured so that a displacement of the shift gate 8 relative to the cam carrier 3 in axial direction causes a change of the angular position of the respective valve-actuating cams 5 and 6 or 20 and 21 in the same or opposite directions. By means of the actuating device 10 thus multiple cam groups 7 and 22, which are assigned to the cam carrier 3 can be caused to assume a defined angular position. The other shift gate 30 on the other hand serves for effecting axial displacement of the entire cam carrier 3 together with all valve-actuating cams 5, 6, 20, 21 and 31 to 34. In principle any number of valve-actuating cams and/or cam groups can be present.

In principle, the shift gate 8 or 30 can be configured in any desired manner. For example they are configured for interacting with a multi-pin-actuator, in particular a two-pin actuator or a three-pin actuator. In contrast to the here shown embodiment these have more than one catch, i.e., two or three in the form of pins. Common to all exemplary embodiments is that the angular position is always adjustable independent of the axial position. In this way for example an adjustment of the cylinder load and/or the charge movement state (which respectively are operating parameters of the angular position) in at least two, preferably, however, more than two different operating states of the internal combustion engine, in which different axial positions are present. The adjustment of the axial position and the angular position can of course occur in any desired order or simultaneously. In principle the main camshaft can be operably connected with the crankshaft via a phase shifter, by means of which phase shifter an angular position of he main camshaft relative to the crankshaft can additionally be adjusted.

What is claimed is:

1. A valve train of an internal combustion engine, comprising:

at least one main camshaft;

at least one cam carrier provided on the at least one main camshaft in rotative fixed relationship with the camshaft and axially displaceable between at least two axial positions;

at least one valve-actuating cam for actuating a gas exchange valve of the internal combustion engine at least one valve-actuating cam being assigned to the cam carrier, said valve-actuating cam being rotataby supported and an angular position of the valve-actuating cam relative to the cam carrier is adjustable by means of an actuating device.

2. The valve train of claim 1, wherein the valve-actuating cam is rotataby supported at the cam carrier and/or the main camshaft.

3. The valve train of claim 1 , wherein the valve-actuating cam is rotataby supported on the cam carrier and/or the main camshaft.

4. The valve train of claim 1, wherein the actuating device has an axially displacable switching element said switching element having a switching toothing, said switching toothing engaging with a cam toothing assigned to the valve-actuating cam, said switching toothing and said cam toothing being configured as helical toothing.

5. The valve train of claim 1, wherein the actuating device comprises at least one actuator shaft constructed for axial displacement and/or rotation relative to the main camshaft and being operably connected with the valve-actuating cam.

6. The valve train of claim 1, wherein the actuator shaft is operably connected with the valve-actuating cam via an adjusting gear.

7. The valve train of claim 1, wherein the adjusting gear comprises at least one gear wheel and is situated in the operative connection between the actuator shaft and the valve-actuating cam.

8. The valve train of claim 7, wherein a shaft toothing of the actuator shaft or the gear wheel is in engagement with the cam toothing of the valve-actuating cam.

9. The valve train of claim 5, wherein the actuator shaft is received in and/or arranged coaxial relative to the main camshaft.

10. The valve train of claim 5, further comprising a holding element operably connecting the actuator shaft with the valve-actuating cam, said holding element traversing the main camshaft.

11. The valve train of claim 5, wherein the adjustment of the angular position and the axial position occurs by means of a single actuator.

* * * * *

UNITED STATES PATENT AND TRADEMARK OFFICE

CERTIFICATE OF CORRECTION

PATENT NO. : 9,228,456 B2
APPLICATION NO. : 14/397445
DATED : January 5, 2016
INVENTOR(S) : Michael Gross, Hendrik Schramm and Moayed El-Gaml It is certified that error appears in the above-identified patent and that said Letters Patent is hereby corrected as shown below:

Title Page
Inventors (72): please correct the third inventor's address "Moayed El-Gaml, Stuttgart (DE)" to read --Moayed El-Gaml, Kassel (DE)--.

Claims

In column 10, claim 1, line 11: please replace "rotataby" with --rotatably--.

In column 10, claim 2, line 2: please replace "rotataby" with --rotatably--.

In column 10, claim 3, line 2: please replace "rotataby" with --rotatably--.

Signed and Sealed this
Nineteenth Day of April, 2016

Michelle K. Lee

Michelle K. Lee
*Director of the United States Patent and Trademark Office*